US007625078B2

(12) United States Patent
Steiger et al.

(10) Patent No.: US 7,625,078 B2
(45) Date of Patent: Dec. 1, 2009

(54) INK CARTRIDGE, INK CARTRIDGE UNIT AND INKJET PRINTING HEAD

(75) Inventors: Martin Steiger, Au (CH); Richard M. Keller, Fehraltdorf (CH)

(73) Assignee: 3T Supplies AG, Schindellegi (CH)

( * ) Notice: Subject to any disclaimer, the term of this patent is extended or adjusted under 35 U.S.C. 154(b) by 93 days.

(21) Appl. No.: 10/985,952

(22) Filed: Nov. 12, 2004

(65) Prior Publication Data

US 2006/0001709 A1 Jan. 5, 2006

(30) Foreign Application Priority Data

Nov. 19, 2003 (EP) ..... 03026434

(51) Int. Cl.
*B41J 2/175* (2006.01)

(52) U.S. Cl. ..... 347/86; 347/85

(58) Field of Classification Search ..... 347/84–87, 347/29

See application file for complete search history.

(56) References Cited

U.S. PATENT DOCUMENTS

| | | | | |
|---|---|---|---|---|
| 5,359,356 | A | 10/1994 | Ecklund | |
| 5,745,139 | A * | 4/1998 | Sasaki | 347/86 |
| 5,790,158 | A | 8/1998 | Shinada et al. | |
| 5,793,396 | A | 8/1998 | Sasaki | |
| 5,917,525 | A * | 6/1999 | Butty | 347/86 |
| 5,949,458 | A | 9/1999 | Studholme | |
| 6,188,417 | B1 * | 2/2001 | Keefe et al. | 347/86 |
| 6,312,115 | B1 * | 11/2001 | Hara et al. | 347/86 |
| 7,128,380 | B2 * | 10/2006 | Hatasa et al. | 347/7 |
| 2002/0075366 | A1 * | 6/2002 | Smith et al. | 347/86 |
| 2003/0048338 | A1 * | 3/2003 | Qingguo et al. | 347/86 |
| 2003/0067518 | A1 * | 4/2003 | Ishinaga et al. | 347/85 |
| 2003/0197765 | A1 | 10/2003 | Dod et al. | |

FOREIGN PATENT DOCUMENTS

| | | |
|---|---|---|
| EP | 1 078 767 | 2/2001 |
| JP | A 03-087266 | 4/1991 |
| JP | A 08-192518 | 7/1996 |
| JP | A 10-086398 | 4/1998 |
| JP | 10-272782 | 10/1998 |
| JP | A 10-329329 | 12/1998 |
| JP | A 2001-260172 | 9/2001 |

* cited by examiner

*Primary Examiner*—Julian D Huffman
*Assistant Examiner*—Jason S Uhlenhake
(74) *Attorney, Agent, or Firm*—Woodard, Emhardt, Moriarty, McNett & Henry LLP

(57) ABSTRACT

A seal (8) which is produced from an elastomer and comprises a contact plate (9) which rests against the outside of the housing and forms a sealing surface (10) surrounding an outlet orifice (12) is inserted into an orifice (7) at the lower end of a housing (2) of an ink cartridge (1). A ring (11) adjacent to the top of the contact plate (9) surrounds a passage connecting to the outlet orifice (12) and leading into the interior of the housing and carries an all-round collar (13) projecting over the edge of the orifice (7) on the inside of the housing, so that the seal (8) is snapped into the orifice (7). Once the ink cartridge (1) has been inserted into a receptacle (24) of an adapter (22), with which it forms an inkjet printing head, the sealing surface (10) presses against a frame which surrounds a receiving orifice (27) of the adapter (22), which receiving orifice is connected to a nozzle plate, so that the ink path is reliably sealed. The ink cartridge (1) can be conveniently inserted by a linear movement.

21 Claims, 4 Drawing Sheets

INK CARTRIDGE, INK CARTRIDGE UNIT AND INKJET PRINTING HEAD

FIELD OF THE INVENTION

The invention relates to an ink cartridge, and an ink cartridge unit and an inkjet printing head, which in each case comprise such an ink cartridge, for use in an inkjet printer.

PRIOR ART

U.S. Pat. No. 6,149,267 A discloses an ink cartridge of the generic type, in which only an orifice in the wall of the chamber is provided as an ink outlet. If the ink cartridge is inserted into a suitable adapter, a nozzle thereof rests with slight lateral play in the orifice. This has the disadvantage that ink can emerge there next to the nozzle and soils the adapter. Conversely, air is enclosed on insertion of the ink cartridge, leading in certain circumstances to an interruption of the ink path. It is therefore necessary to provide, on that side of the housing which is opposite to the ink outlet, a pump element by means of which pressure can be built up in the chamber and the ink can be driven through the outlet orifice. However, such a pump element makes the ink cartridge more expensive. Moreover, it is troublesome that the ink cartridge, which is generally poorly accessible after insertion, still has to be made ready for use by pumping.

In another otherwise similar solution (U.S. Pat. No. 5,784,088 A), the nozzle of the adapter is therefore surrounded at its base by a sealing ring which presses against the housing of the ink cartridge. This solution, too, is not satisfactory since the space between the storage body and the sealing ring can nevertheless become soiled between the nozzle and a collar of the ink cartridge, which collar holds said nozzle. Moreover, the sealing ring can be mounted only with difficulty if the adapter has a receptacle for the ink cartridge, as is desirable with regard to secure fixing and guidance thereof, on insertion.

According to U.S. Pat. No. 5,767,881 A, with an otherwise similar design, a sealing ring which cooperates with the collar which holds the nozzle is arranged on the outside of the nozzle. However, the sealing ring is relatively difficult to mount on the bottom of the receptacle. Moreover, it must be slightly compressed when the ink cartridge is inserted, so that the seal performs reliably. On removal and on insertion of the ink cartridge, relatively great friction between the sealing ring and the collar therefore has to be overcome, complicating these processes. The ink path in the adapter can easily be interrupted, since relatively large cavities are present between the advanced receiving orifice closed by a porous plate and a screen installed between said orifice and the nozzle plate. Here too, a pump element is therefore required, making the ink cartridge more expensive and complicating its operation.

SUMMARY OF THE INVENTION

It is the object of the invention to provide an ink cartridge of the generic type which can cooperate with a simply designed adapter so that the ink path is reliably sealed so that no troublesome soiling can occur and so that it can be both easily inserted and removed. This object is achieved by the features in the characterizing clause of claim 1.

Ink cartridges according to the invention can be inserted in a simple manner by pushing in straight, substantially without friction. The ink path to the adapter is thus produced without further measures. Nevertheless, emergence of ink is reliably suppressed. The ink cartridge according to the invention can also be very easily removed again.

The invention also provides an ink cartridge unit in which the outlet orifice is reliably closed in a very simple manner so that said unit can be transported and stored safely and without problems. An inkjet printing head which, in addition to the ink cartridge according to the invention, comprises an adapter having a nozzle plate, on which said ink cartridge can be fastened, is also described. The adapter has a very simple design and cooperates with the ink cartridge according to the invention so that the ink path is reliably sealed and interruption thereof cannot occur.

BRIEF DESCRIPTION OF THE DRAWINGS

Below, the invention is explained in more detail with reference to figures which show only an embodiment.

DESCRIPTION OF THE PREFERRED EMBODIMENTS

Figure 1:
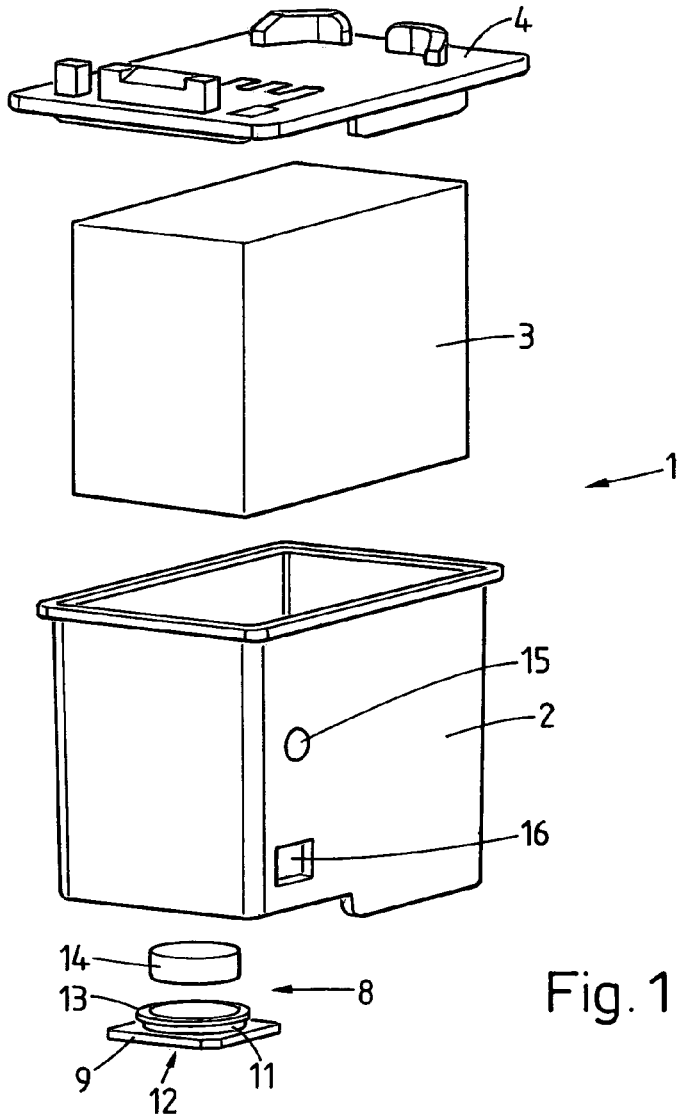
FIG. 1 shows an exploded diagram of an ink cartridge according to the invention.
Figure 5:
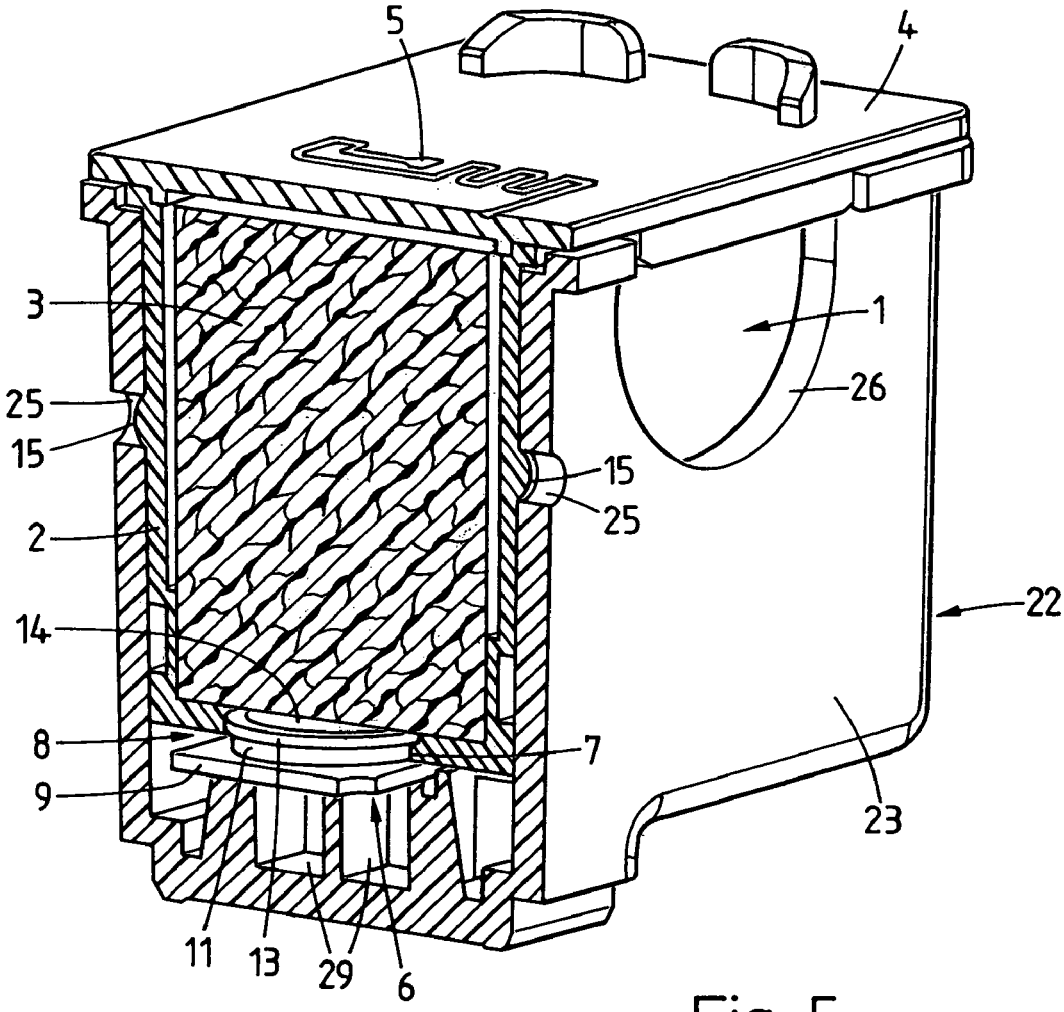
FIG. 5 shows an inkjet printing head according to the invention, partly cut away.
Figure 6:
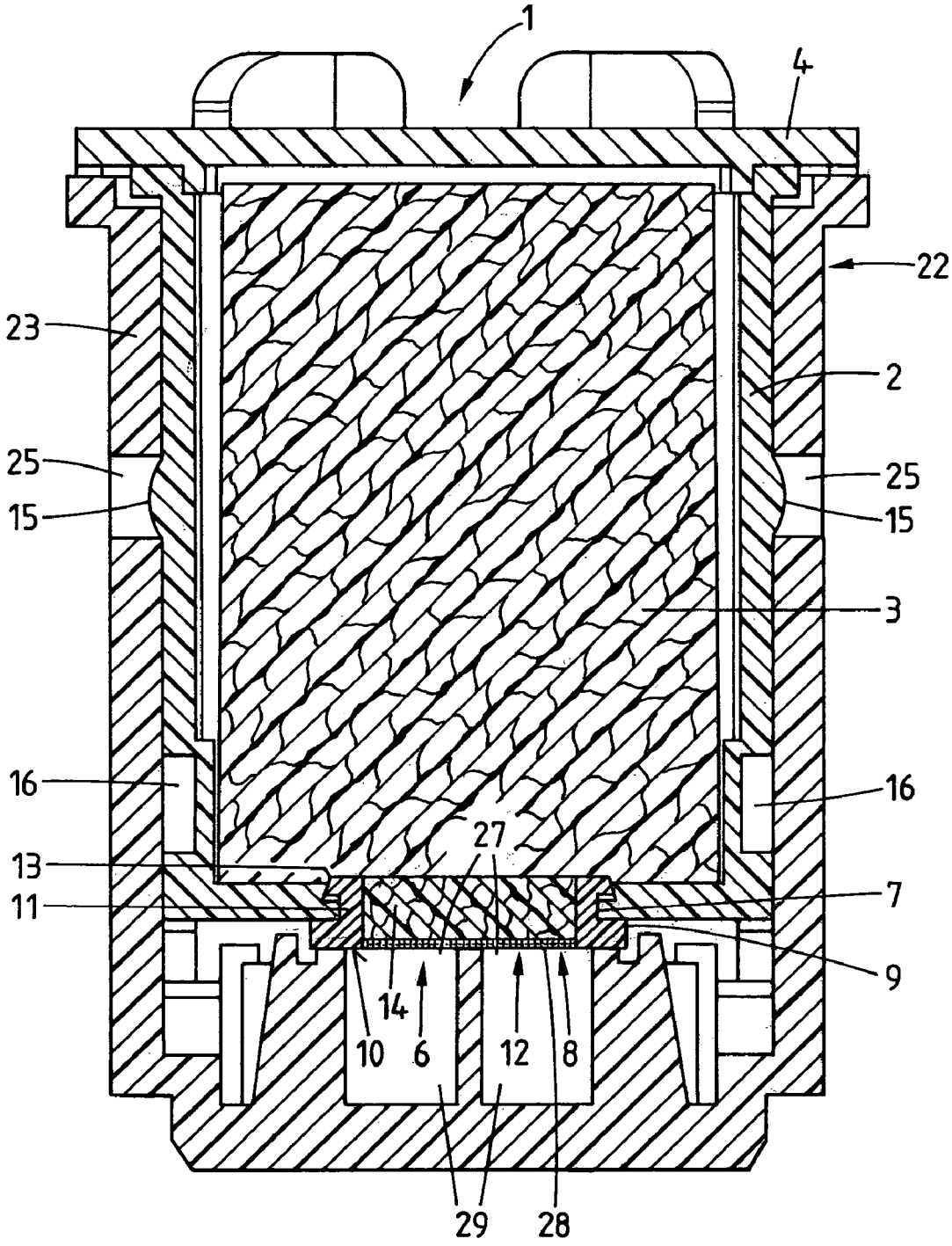
FIG. 6 shows a section through the inkjet printing head according to FIG. 5.

The inkjet cartridge 1 according to the invention (FIG. 1, 5, 6) has a housing 2 which surrounds a chamber which contains a storage body 3 made from open-pore foam and saturated with ink and which is closed by a cover 4 having an air orifice 5. The air orifice 5 opens at the top of the cover 4 into a meandering depression which widens at the end. With the exception of the wider part at the end, the depression can be covered by, for example, an adhesive label and forms an expansion space which takes up ink if necessary. An ink outlet 6 is provided at the base of the housing 2. For this purpose, the housing has an orifice 7 there (FIG. 5), into which a seal 8 is inserted.

The seal 8 comprises an approximately square contact plate 9, the top of which rests against the bottom of the housing 2 and the bottom of which forms an exposed sealing surface 10, and a ring 11 adjacent at the top thereof to the contact plate 9 and integral with said contact plate. In order to prevent rotation, the contact plate 9 is slightly shortened at one corner and there abuts a cam projecting from the underside of the housing 2. Located in the centre of the sealing surface 10 is an outlet orifice 12, to which connects a passage which is surrounded by the ring 11 and connects said outlet orifice to the chamber in the interior of the housing 2. The ring 11 has, at the upper end, a radially outward-projecting all-round collar 13 which, on the inside of the housing 2, projects over the slightly indented edge of the orifice 7 and thus locks the seal 8 therein by snapping in, so that it cannot be removed without deformation. At the same time, the collar 13 improves the seal between the edge of the orifice 7 and the outside of the ring 11. Present in the outlet orifice 12 is a guide element 14 connected to the seal 8, a small round plate which consists of porous material, for example of open-pore foam or of parallel fibres which lead axially outwards from the interior of the chamber.

On the side walls, the housing 2 has two spherical cap-shaped shallow locking cams 15 opposite one another and, in each case slightly below these, not far away from the bottom edge, rectangular depressions 16. The housing 2 and the cover 4 consist of plastic, preferably of polypropylene. The storage body 3 may consist of PUR, and the guide element 14, if it is in the form of a foam body, likewise, if it is in the form of a fibre bundle, of polyester. The contact plate 9 and the ring 11 consist of a material which is resilient and softer than the material of the housing 2, for example of a thermoplastic elastomer.

Figure 3:
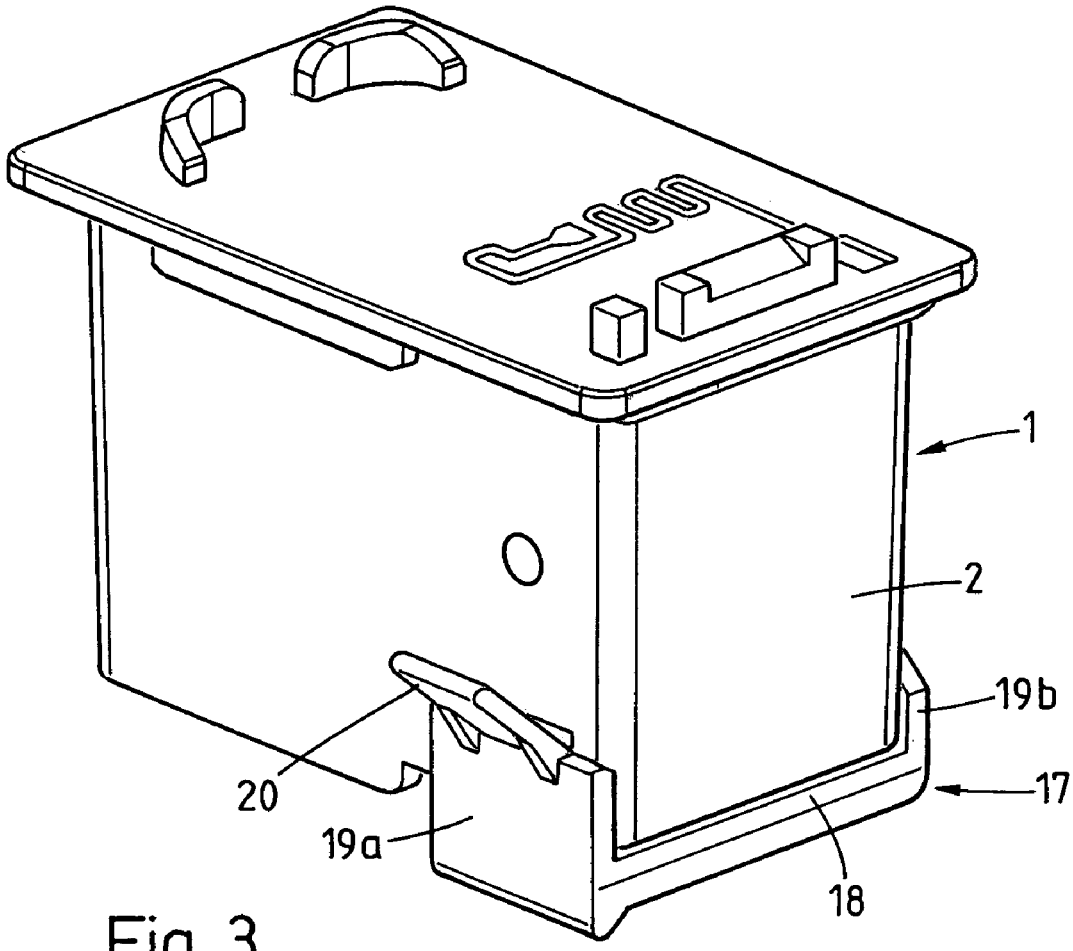
FIG. 3 shows an inkjet unit according to the invention.
Figure 4:
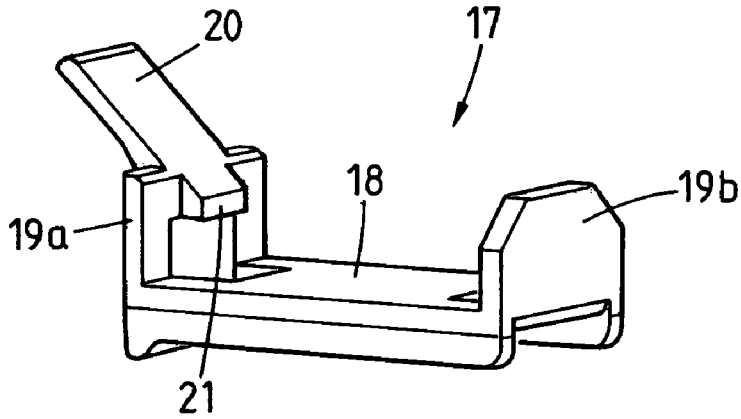
FIG. 4 shows a closure part of the ink cartridge unit according to FIG. 3.

For shipping and storage, the ink cartridge 1 is supplemented by (FIG. 3, 4) a closure part 17 for an ink cartridge unit. The one-piece closure part 17 comprises a rectangular closure plate 18 and, at the opposite ends thereof, parallel retaining wings 19*a,b* which project approximately at right angles and of which the retaining wing 19*a* has an obliquely projecting tab 20. Each of the retaining wings 19*a,b* carries a lug 21 projecting towards the respective opposite retaining wing 19*b;a*. The closure part 17 is fastened by a snap-like locking means to the housing 2 of the ink cartridge 1 by virtue of the fact that the lugs 21 engage the depressions 16. The top of the closure plate 18 presses against the sealing surface 10 so that the outlet orifice 12 is reliably and tightly sealed. By pressing against the top of the tab 20, the snap lock can be released and the closure part 17 can be removed. The closure part 17 consists of a relatively rigid resilient plastic, e.g. polypropylene.

Figure 2:
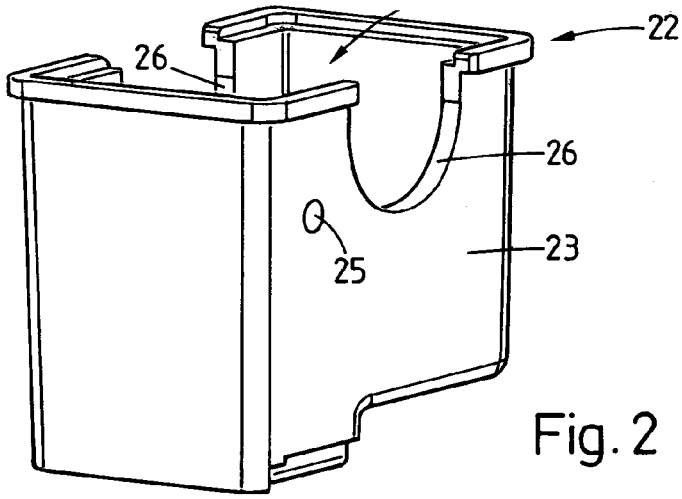
FIG. 2 shows an adapter of an inkjet printing head according to the invention.

The ink cartridge 1, together with an adapter 22 (FIG. 2, 5, 6) forms an inkjet printing head, as used in inkjet printers. The adapter 22 has a housing 23 which forms a receptacle 24 which is open at the top and into which the ink cartridge 1 can be inserted. The side walls of the housing 23 have round snap-in holes which are opposite one another and which the locking cams 15 engage so that the inserted ink cartridge 1 is snapped into the adapter 22. At the upper edge, they also have semicircular recesses 26 which facilitate the insertion and removal of the ink cartridge 1.

On the underside, the housing 23 carries a nozzle plate (not shown) for controlled release of ink drops. Nozzle plates and their control are well known. At the bottom of the receptacle 24, the adapter 22 has a receiving orifice 27 which is surrounded by an offset frame and in which is arranged a screen-like filter 28 which, for example, is in the form of a braid of metal wires and serves for trapping relatively large particles which might otherwise block the nozzles of the nozzle plate, with which the receiving orifice 27 is connected via a cavity 29 connecting thereto and lines (not shown).

The snap connection effective between the adapter 22 and the ink cartridge 1 is designed so that the sealing surface 10 presses frontally against the frame of the receiving orifice 27, and that the ink path leading from the chamber of the ink cartridge 1 through the outlet orifice 12 and the receiving orifice 27 to the cavity 29 is reliably sealed from the outside, i.e. the surrounding regions of the receptacle 24, and the ink is conducted from the storage body 3 to the nozzle plate without it being possible for the ink flow to be interrupted by air penetrating from the surrounding region of the receptacle 24 or, conversely, for ink to emerge into the receptacle 24. The housing 23 of the adapter 22 likewise consists of plastic, for example glass-fibre reinforced PET.

The ink cartridge 1 can be very simply inserted by a linear movement into the receptacle 24. The ink path is automatically sealed, without there being any friction, during insertion of the ink cartridge 1, between the seal and opposite surfaces with which it cooperates, which friction might hinder the insertion. Troublesome insertion of a seal on the bottom of the receptacle is not required.

The ink cartridge described and the closure part and the adapter can be modified in many respects. In particular, the ink cartridge may be suitable for colour printing and may have a plurality of separate chambers, for example three or four separate chambers, each having a storage body, which is impregnated with an ink of a different colour, and an ink outlet. The adapter must then be correspondingly formed, with a plurality of receiving orifices and suitable nozzle plate and control. Alternatively, it may be provided with three or four receptacles having in each case a receiving orifice, which receptacles are suitable in each case for receiving an ink cartridge having a single chamber which contains ink of a certain colour.

LIST OF REFERENCE SYMBOLS

1 Ink cartridge
2 Housing
3 Storage body
4 Cover
5 Vent orifice
6 Ink outlet
7 Orifice
8 Seal
9 Contact plate
10 Sealing surface
11 Ring
12 Outlet orifice
13 Collar
14 Guide element
15 Locking cam
16 Depression
17 Closure part
18 Closure plate
19*a,b* Retaining wings
20 Tab
21 Lug
22 Adapter
23 Housing
24 Receptacle
25 Snap-in hole
26 Recess
27 Receiving orifice
28 Filter
29 Cavity

The invention claimed is:

1. An inkjet cartridge for an inkjet printer, comprising:

a housing that encloses at least one chamber filled by a porous storage body for taking up ink, the housing having a top and bottom, and at the bottom an ink outlet with an outlet opening and at the top a vent opening, a one-piece seal of soft resilient material attached to the housing with a contact plate resting with a backside against an outside of the housing, a frontside opposite the backside providing an exposed sealing surface facing away from the housing and surrounding an outlet orifice of the ink outlet, and a ring integral with the contact plate and adjacent to the backside of the same, the ring being arranged in the outlet opening of the ink outlet with an outside of the ring resting against the edge of the outlet opening and surrounding a passage which connects the chamber to the outlet orifice.

2. An inkjet cartridge for an inkjet printer, comprising:

a housing that encloses at least one chamber filled by a porous storage body for taking up ink, the housing having a top and bottom, and at the bottom an ink outlet with an outlet opening and at the top a vent opening, a one-piece seal of soft resilient material attached to the housing with a contact plate resting with a backside against an outside of the housing, a frontside opposite the backside providing an exposed sealing surface facing away from the housing and surrounding an outlet orifice of the ink outlet, and a ring integral with the contact plate and adjacent to the backside of the same, the ring being arranged in the outlet opening of the ink outlet with an outside of the ring resting against the edge of the outlet opening and surrounding a passage which connects the chamber to the outlet orifice; and a closure part which is removably fastened to the ink cartridge so that it closes the outlet orifice and rests against the sealing surface.

3. The ink cartridge unit according to claim 2, wherein the closure part is resilient and is fastened to the ink cartridge by means of a snap-in lock.

4. The ink cartridge unit according to claim 3, wherein the closure part is in the form of a clamp, the closure part including a closure plate closing the outlet orifice and two retaining wings which project approximately parallel therefrom and rest against opposite sides of the housing of the ink cartridge.

5. An inkjet printing head comprising: at least one ink cartridge with:

a housing that encloses at least one chamber filled by a porous storage body for taking up ink, the housing having a top and a bottom, and at the bottom an ink outlet with an outlet opening and at the top a vent opening, and a one-piece seal of soft resilient material which comprises a contact plate fixed to the housing, the contact plate resting with a backside against an outside of the housing, a frontside opposite the backside providing a sealing surface facing away from the housing and surrounding an outlet orifice of the ink outlet, and further comprising:

an adapter to which the at least one ink cartridge can be fastened, the adapter having, on its underside, a nozzle plate provided with nozzle orifices, and a receiving orifice for ink connected to at least a part of the nozzle orifices, the receiving orifice being surrounded by a frame which, when the at least one ink cartridge is fastened to the adapter, surrounds the outlet orifice of the said ink cartridge and rests against the sealing surface thereof.

6. The inkjet printing head according to claim 5, wherein the seal of the at least one ink cartridge comprises a ring integral with the contact plate and adjacent to the backside of the same, the ring being arranged in the outlet opening of the ink outlet with the outside of the ring resting against the edge of the outlet opening and surrounding a passage which connects the chamber to the outlet orifice.

7. The inkjet printing head according to claim 5, wherein the adapter has a receptacle for taking up and fastening the at least one ink cartridge, with the receiving orifice arranged on a bottom of the receptacle.

8. The inkjet printing head according to claim 7, wherein the inkjet printing head is fastened to the adapter by being snapped into the receptacle of the same.

9. The inkjet printing head according to claim 5, wherein the adapter comprises a screen-like filter arranged between the receiving orifice and the nozzle orifice.

10. The inkjet printing head according to claim 9, wherein the filter is arranged in the receiving orifice.

11. An ink cartridge for an inkjet printer, comprising:

a housing that encloses at least one chamber filled by a porous storage body for taking up ink, the housing having a top and bottom, and at the bottom an ink outlet with an outlet opening and at the top a vent opening, a one-piece seal of soft resilient material attached to the housing with a contact plate resting with a backside against an outside of the housing, a frontside opposite the backside providing a sealing surface facing away from the housing and surrounding an outlet orifice of the ink outlet, and a ring integral with the contact plate and adjacent to the backside of the same, the ring being arranged in the outlet opening of the ink outlet with an outside of the ring resting against the edge of the outlet opening and surrounding a passage which connects the chamber to the outlet orifice, wherein the ring carries, at its end facing away from the contact plate, a collar projecting, on the inside of the housing, outward over the boundary of the outlet opening so that the seal is snapped into the orifice.

12. The ink cartridge according to claim 11, wherein the contact plate is substantially square.

13. The ink cartridge according to claim 11, wherein the seal consists of an elastomer.

14. The ink cartridge according to claim 11, wherein the passage surrounded by the ring is taken up by a guide element of porous material.

15. The ink cartridge according to claim 14, wherein the guide element is connected to the seal.

16. The ink cartridge according to claim 14, wherein the guide element substantially consists of parallel fibres oriented outwards from the chamber.

17. An ink cartridge unit, comprising:

an ink cartridge according to claim 11; and a closure part which is removably fastened to the ink cartridge so that it closes the outlet orifice and rests against the sealing surface.

18. The ink cartridge unit according to claim 17, wherein the closure part is resilient and is fastened to the ink cartridge by means of a snap-in lock.

19. The ink cartridge unit according to claim 18, wherein the closure part is in the form of a clamp, the closure part including a closure plate closing the outlet orifice and two retaining wings which project approximately parallel therefrom and rest against opposite sides of the housing of the ink cartridge.

20. An ink cartridge for an inkjet printer, comprising:

a housing that encloses at least one chamber filled by a porous storage body for taking up ink, the housing having a top and a bottom, and at the bottom an ink outlet with an outlet opening and at the top a vent opening, a one-piece seal of soft resilient material which comprises a contact plate fixed to the housing, the contact plate resting with a backside against an outside of the housing, a frontside opposite the backside providing a sealing surface facing away from the housing and surrounding an outlet orifice of the ink outlet, and a connection element adapted for interacting with an adapter and for removably attaching the cartridge to the adapter, wherein the sealing surface is exposed after the sealing surface and connection element have been operatively placed and prior to receiving a frame of the adapter, the adapter comprised of:

a nozzle plate provided with nozzle orifices, and a receiving orifice for ink connected to at least a part of the nozzle orifices, the receiving orifice being surrounded by a frame which, when the at least one ink cartridge is fastened to the adapter, surrounds the outlet orifice of the ink cartridge and rests against the sealing surface thereof.

21. The ink cartridge according to claim 20, wherein the connection element is a locking cam.

* * * * *